US010843197B2

(12) United States Patent
Yu et al.

(10) Patent No.: US 10,843,197 B2
(45) Date of Patent: Nov. 24, 2020

(54) FLUIDIC CONNECTOR, MICROFLUIDIC CHIP CARTRIDGE, AND FLUIDIC CONNECTOR ASSEMBLY THEREOF

(71) Applicant: MiCareo Taiwan Co., Ltd., Taipei (TW)

(72) Inventors: Hui-Min Yu, Taipei (TW); Jui-Lin Chen, Taipei (TW)

(73) Assignee: MiCareo Taiwan Co., Ltd., Taipei (TW)

( * ) Notice: Subject to any disclaimer, the term of this patent is extended or adjusted under 35 U.S.C. 154(b) by 510 days.

(21) Appl. No.: 15/812,902

(22) Filed: Nov. 14, 2017

(65) Prior Publication Data

US 2019/0143332 A1 May 16, 2019

(51) Int. Cl.
*B01L 3/00* (2006.01)

(52) U.S. Cl.
CPC ..... *B01L 3/563* (2013.01); *B01L 3/502707* (2013.01); *B01L 3/502715* (2013.01); *B01L 2200/027* (2013.01); *B01L 2200/12* (2013.01); *B01L 2400/0487* (2013.01)

(58) Field of Classification Search
None
See application file for complete search history.

(56) References Cited

U.S. PATENT DOCUMENTS

| | | | | |
|---|---|---|---|---|
| 8,021,056 | B2 | 9/2011 | Arnold et al. | |
| 8,202,491 | B2 * | 6/2012 | Masters | B01L 3/502715 422/500 |
| 2008/0208325 | A1 * | 8/2008 | Helmus | A61L 27/427 623/1.44 |

FOREIGN PATENT DOCUMENTS

| | | |
|---|---|---|
| CN | 101657260 B | 2/2010 |
| CN | 101313168 B | 4/2013 |
| TW | 579430 | 3/2004 |

* cited by examiner

*Primary Examiner* — Jyoti Nagpaul

(57) ABSTRACT

The present invention provides a fluidic connector, to combine with a microfluidic chip cartridge, comprising: a base, having a plurality of through holes; and a plurality of soft tubes, penetrating the base via the through holes and fixed on the base, and having a Shore A hardness in a range of 50-99, wherein an end of the plurality of soft tubes is protruded from a first side of the base to form plurality of protrusion portions and each protrusion portion has a length in a range of 0.5-10 mm. The present invention also provides a microfluidic chip cartridge and a fluidic connector assembly.

4 Claims, 8 Drawing Sheets

FLUIDIC CONNECTOR, MICROFLUIDIC CHIP CARTRIDGE, AND FLUIDIC CONNECTOR ASSEMBLY THEREOF

FIELD OF THE INVENTION

The present invention relates to structures of a fluidic connector, a microfluidic chip cartridge, and a fluidic connector assembly thereof.

BACKGROUND OF THE INVENTION

In the recent years, fluidic and microfluidic systems have become more and more important, allowing performing chemical and/or biological methods on a mesoscopic or microscopic scale. A microfluidic chip is developed for a "laboratory-on-a-chip" device, which is a miniaturized device that integrates onto a single chip for one or several analyses, which are usually done in a laboratory or in-vitro diagnostic testing, such as DNA sequencing or biochemical detection.

A microfluidic chip contains a pattern of microchannels molded or engraved therein. This network of microchannels incorporated into the microfluidic chip is linked up to the macro-environment by several input/output holes of different dimensions hollowed out through the chip. It is through these pathways that fluids are put in and evacuated from the microfluidic chip. Fluids are directed, mixed, separated or elseways manipulated to attain multiplexing, automation, and high-throughput systems. The input/output holes that the liquids (or gases) are injected and removed from the microfluidic chip with external active systems (pressure controller, push-syringe or peristaltic pump) or passive ways (e.g. hydrostatic pressure).

Conventionally, a plurality of independent tubes is respectively connected to the output holes manually one-by-one for the liquids out from the microfluidic chip. However, as the network getting more complicated, it requires more microchannels to be integrated therein. Therefore, there are demands for a plurality of, or even dozens of, tubes to be securely plugged into a microfluidic chip at a time.

SUMMARY OF THE INVENTION

An aspect of the present invention provides a fluidic connector, to combine with a microfluidic chip cartridge, comprising: a base, having a plurality of through holes; and a plurality of soft tubes, penetrating the base via the through holes and fixed on the base, and having a Shore A hardness in a range of 50-99, wherein an end of the plurality of soft tubes is protruded from a first side of the base to form plurality of protrusion portions and each protrusion portion has a length in a range of 0.5-10 mm.

In one embodiment of the present invention, wherein every one of the through holes has a chamfer to guide the plurality of soft tubes to penetrate the base via the through holes.

In one embodiment of the present invention, wherein the base further has at least one plug pin on the first side of the base to combine with the microfluidic chip cartridge.

In one embodiment of the present invention, wherein the base further has a groove on a second side opposite to the first side, the through holes are at a bottom of the groove, and the plurality of soft tubes penetrate the groove and the through holes accordingly.

In one embodiment of the present invention, wherein the plurality of soft tubes are fixed in the groove by an adhesive.

In one embodiment of the present invention, wherein the Shore A hardness of the plurality of soft tubes is in a range of 70-99.

In one embodiment of the present invention, the fluidic connector further comprises an extension portion, connected to the base, having at least one channel to place an exposed portion of the plurality of soft tubes.

In one embodiment of the present invention, wherein the length of the protrusion portion is in a range of 4.4-10 mm, and the Shore A hardness is in a range of 70-99.

An aspect of the present invention provides a microfluidic chip cartridge, to combine with a fluidic connector, comprising: a microfluidic chip; a case body, having a recess on a first side of the case body to receive the microfluidic chip; a first fluid delivery interface on a second side of the case body, having plurality of fluid guide channels connecting the bottom of the recess; and a second fluid delivery interface on the second side of the case body, having at least two fluid guide channels connecting the bottom of the recess; wherein a portion of the first fluid delivery interface is separated from the second fluid delivery interface to form a hollow window on the second side of the case body, therefore the partial microfluidic chip would be exposed outside of the case body.

In one embodiment of the present invention, wherein each fluid delivery channel of the first fluid delivery interface has a proximal end and a terminal end, each proximal end has a chamfer and is contacted with the fluidic connector, and the terminal end is aligned with a corresponding inlet/outlet of the microfluidic chip.

In one embodiment of the present invention, wherein each fluid delivery channel of the second fluid delivery interface has a proximal end and a terminal end, and each proximal end is wider than the corresponding terminal end.

In one embodiment of the present invention, the microfluidic chip cartridge further comprises a holder, connected to the case body along an extending direction of the case body.

In one embodiment of the present invention, the microfluidic chip cartridge further comprises: at least one pin hole to combine with at least one plug pin of the fluidic connector.

An aspect of the present invention is to provide a fluidic connector assembly, comprising: the fluidic connector and the microfluidic chip cartridge, wherein the microfluidic chip is fastened in the recess of the case body by a transparent carrier, which is affixed on the first side of the case body; and wherein the protrusion portions of the soft tubes pass through the fluid guide channels of the first fluid delivery interface and are inserted into the microfluidic chip.

In one embodiment of the present invention, wherein the fluidic connector further comprises at least one plug pin, the case body further has at least one pin hole on the second side, and at least one plug pin is inserted into the at least one pin hole to combine with the fluidic connector and the microfluidic chip cartridge.

In one embodiment of the present invention, wherein each fluid delivery channel of the first fluid delivery interface has a proximal end and a terminal end, each proximal end has a chamfer to guide the protrusion portion of the soft tube in to the microfluidic chip, and the terminal end is connected to a corresponding inlet/outlet of the microfluidic chip.

In one embodiment of the present invention, wherein the length of the protrusion portion is in a range of 4.4-10 mm, and the Shore A hardness is in a range of 70-99.

Accordingly, the present invention provides a fluidic connector, a microfluidic chip cartridge, and a microfluidic chip assembly thereof to improve efficiency and accuracy of insertion of inlet/outlet tubes to a microfluidic chip. The fluidic connector, microfluidic chip cartridge, and microfluidic chip assembly can be used independently in individual laboratory or analysis, or can be applied in an analysis platform machine.

BRIEF DESCRIPTION OF THE DRAWINGS

The present invention will become more readily apparent to those ordinarily skilled in the art after reviewing the following detailed description and accompanying drawings.

DETAILED DESCRIPTION OF PREFERRED EMBODIMENTS

The present invention provides a fluidic connector, a microfluidic chip cartridge, and a microfluidic chip assembly thereof to improve efficiency and accuracy of insertion of inlet/outlet tubes to a microfluidic chip. It is to be noted that the following descriptions of preferred embodiments of this invention are presented herein for purpose of illustration and description only but not intended to be exhaustive or to be limited to the precise form disclosed.

In the following illustration, the element arranged repeatedly is described in word "one", "a" or "an" for simpler explanation. However, one skilled in the art should understand the practical structure and arrangement of each element based on the following illustration and figures provided in the present application.

Figure 1A:
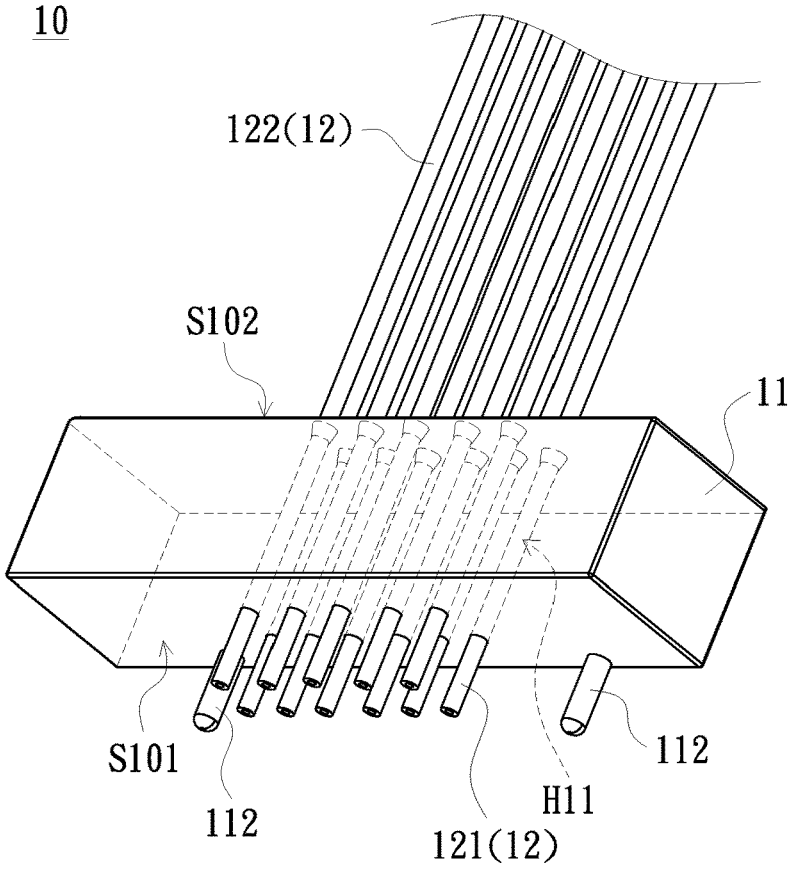
FIG. 1A is a fluidic connector according to the present invention.
Figure 2A:
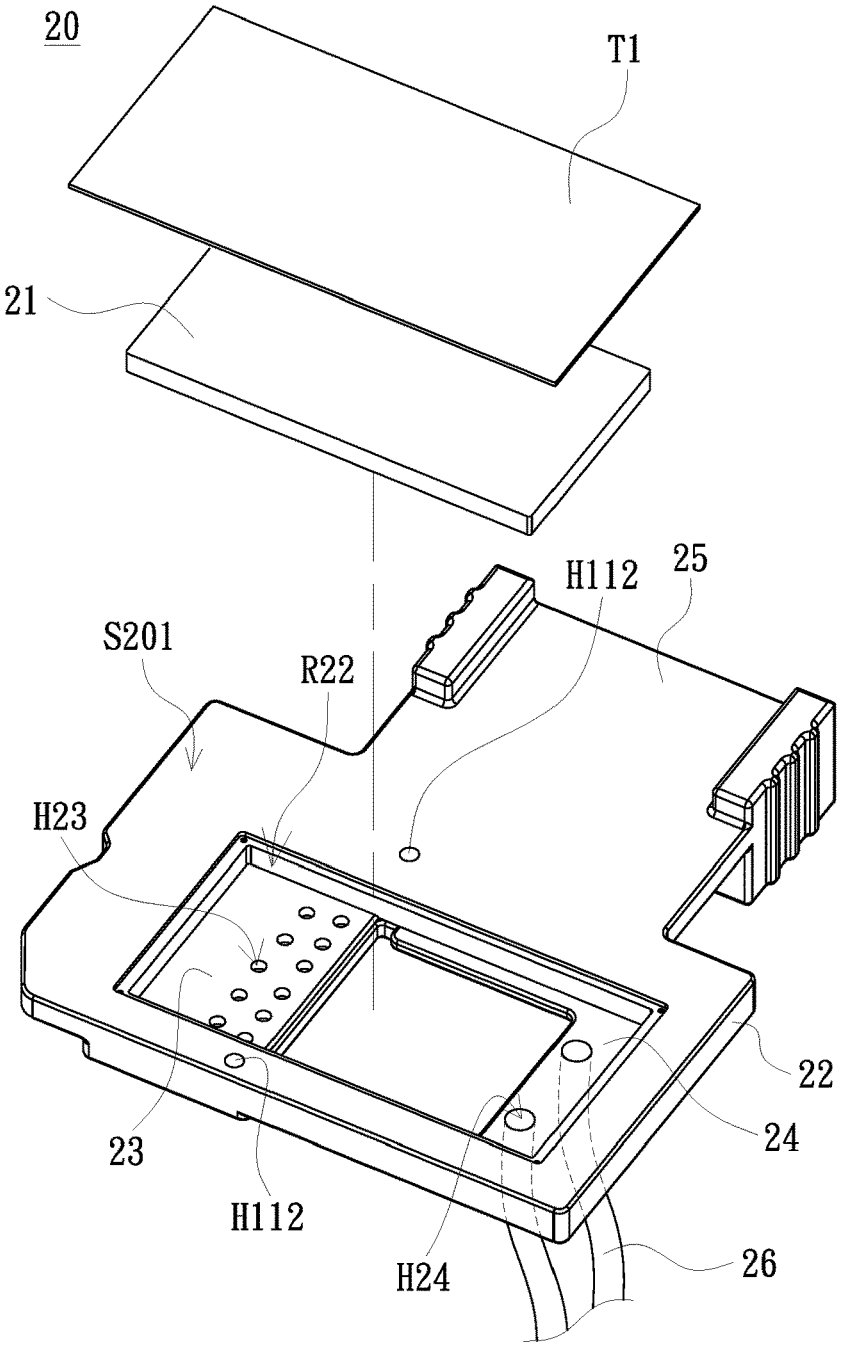
FIG. 2A is a bottom view of a microfluidic chip cartridge according to an embodiment of the present invention.

As shown in FIG. 1A, the present invention provides a fluidic connector 10, to combine with a microfluidic chip cartridge 20 as shown in FIG. 2A, comprising: a base 11 and a plurality of soft tubes 12. The base 11 has a plurality of through holes H11, and the soft tubes 12 penetrate the base 11 via the through holes H11. More specifically, the plurality of soft tube 12 has a Shore A hardness in a range of 50-99 and penetrates through two opposite sides (a first side S101 and a second side S102) of the base 11, wherein an end of the plurality of soft tubes 12 is protruded from the first side S101 of the base 11 to form a plurality of protrusion portions 121, and each protrusion portion 121 has a length in a range of 0.5-10 mm. The other end of the plurality of soft tubes 12 is protruded from the second side S102, which is opposite to the first side S101, of the base 11 to form a plurality of exposed portions 122, and a length of the exposed portion 121 is not limited herein. A length and a hardness of the protrusion portion 121 are correlate to each other; and for the protrusion portion 121 to be easily inserted into a microfluidic chip without damage, longer the protrusion portion 121 is, a higher hardness of the soft tube 12 is required. In preferred embodiments of the present invention, the length of the protrusion portion 121 is in a range of 4.4-10 mm, and the Shore A hardness of the soft tube 12 is in a range of 70-99.

The base 11 may further include at least one plug pin 112 on the first side S101 of the base 11 to combine with the microfluidic chip cartridge 20. In the embodiment as shown in FIG. 1A, the base 11 has two plug pins 112; however, a need of the plug pin 112 or a number of the plug pin 112 is not limited herein, and it can be adjusted by different applications.

Figure 1B:
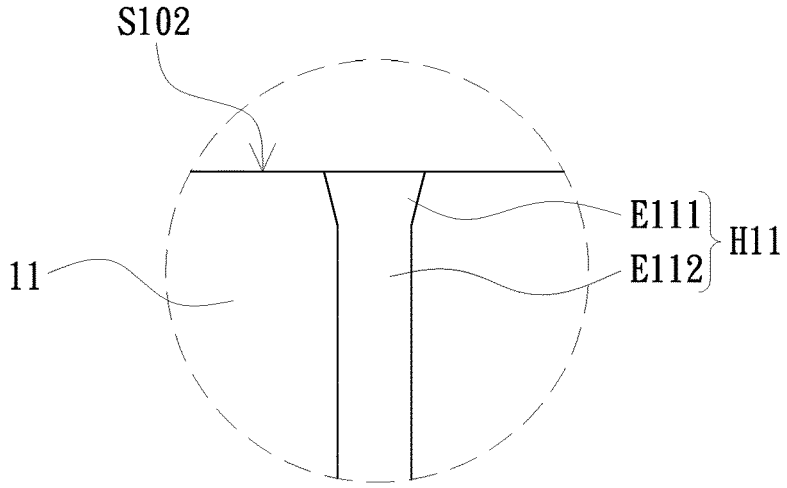
FIG. 1B is a partial enlarged diagram of the fluidic connector as shown in FIG. 1A.

According to an embodiment of the present invention, in order for the soft tubes 12 to easily assemble with the base 11, every one of the through holes H11 has a chamfer, as shown in FIG. 1B enlarging a part of the base 11 shown in FIG. 1A, to guide the plurality of soft tubes 12 to penetrate the base 11 via the through holes H11. The through hole H11 has a proximal end E111 at the second side S102 and a terminal end E112 at the first side S101. The proximal end E111 has a chamfer as shown in FIGS. 1B and 1*s* tapered down from the second side S102 of the base 11 to interconnect with the terminal end E112, which is cylindrical, of the through hole H11 therefore to penetrate through the two opposite sides of the base 11.

And for the purpose of immobilization of the soft tubes 12 on the base 11, the soft tubes 12 are fixed in the through holes H11 by an adhesive, e.g. UV curable adhesives; however an adhesive is not required but depending on different applications. The soft tubes 12 can also be fixed in the through holes H11 by engagement in the case of the sizes of the through holes are small enough for each of the soft tubes 12 to pass through and fastened by the inner wall of each through hole H11.

Figure 1C:
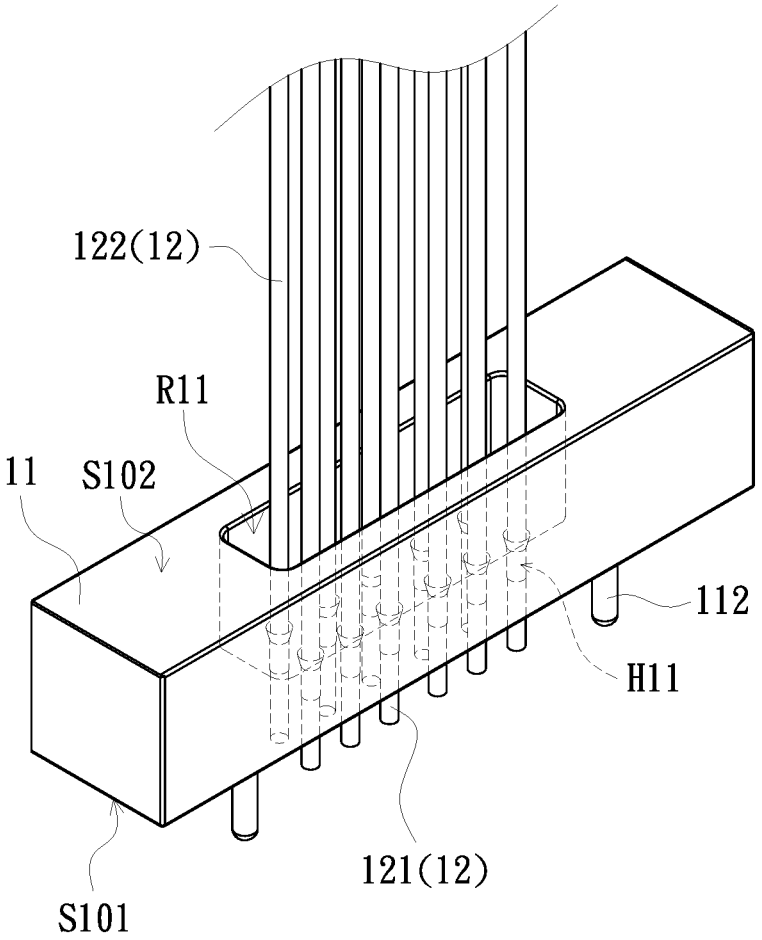
FIGS. 1C and 1D are fluidic connectors according to different embodiments of the present invention.

The soft tubes 12 pass through the base 11 merely via the through holes H11 as shown in FIG. 1A; or in another embodiment of the present invention, the base 11 as shown in FIG. 1C further has a groove R11 at the second side S102 of the base 11. The elements with similar or the same functions as those of shown in FIG. 1A use the same element numbers for easier illustration, but it is not intended to limit the present invention. The groove R11 covers all the plurality of the through holes H11; hence in the embodiment, the through holes H11 are at a bottom of the groove R11, and the plurality of soft tubes 12 penetrate the base 11 via the groove R11 and the through holes 112 accordingly. In addition, in this embodiment, the plurality of soft tubes 112 is fixed in the groove R11 by an adhesive. The formation of the through holes H11 of this embodiment is similar to the through holes H11 as illustrated above and in FIGS. 1A and 1B, and it is not repeated here for purpose of brevity.

Figure 1D:
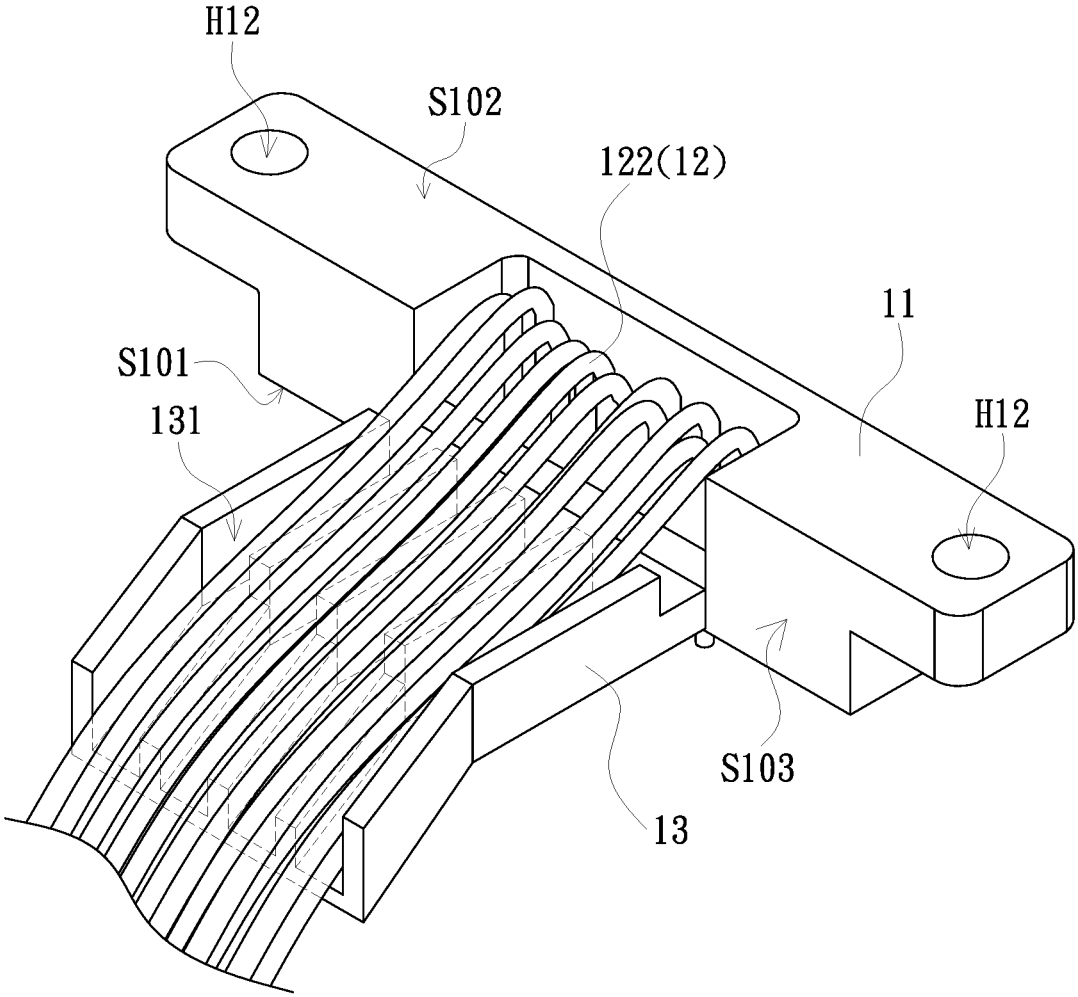

According to another embodiment of the present invention, in order to assemble the fluidic connector 10 with an analysis platform machine, e.g. product name of Miselect by MiCareo Taiwan Co., Ltd. and MiCareo Inc., the fluidic connector 10 further includes an extension portion 13 as shown in FIG. 1D. The elements in FIG. 1D with similar or the same functions as those of shown in the FIGS. 1A-1C also use the same element numbers for easier illustration, but it is not intended to limit the present invention. In this embodiment, the groove R11 is opened on not just the second side S102 of the base 11, but also a third side S103, which connects the first side S101 and the second side S102 of the base 11, and the extension portion 13 is connected to the base 11 therefrom and has at least one bracket 131 to place the exposed portions 122 of the plurality of soft tubes 12. The soft tubes 12 are therefore can be held in the fluidic connector 10 for space saving, and also the fluidic connector 10 can better (and more tightly) assemble with the analysis platform machine. Additionally, in order for the base 11 to fix on the analysis platform machine, the base 11 has a T-shaped structure as shown in FIG. 1D and with pin holes H12 formed on the second side S102 at two lateral sides of the T-shaped structure (not labelled). The pin hole H12 can be a through hole or not, and it is not limited herein as long as the fluidic connector 10 can be stably fixed on the analysis platform machine.

Figure 2B:
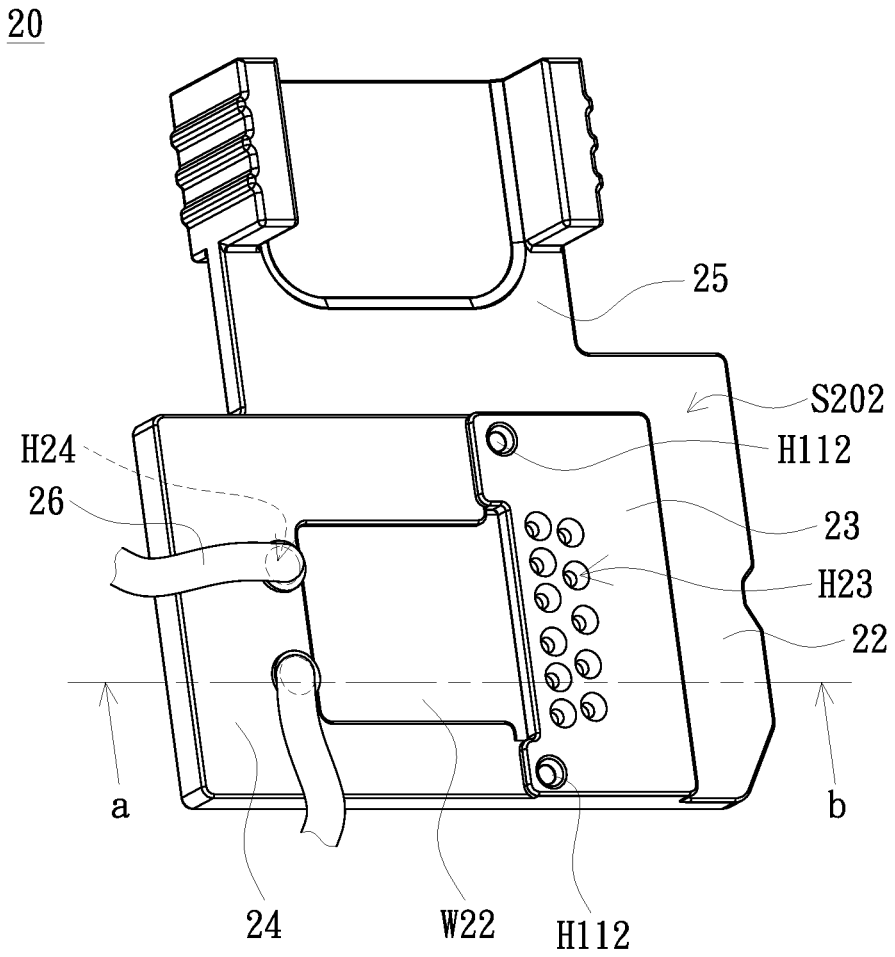
FIG. 2B is a top view of the microfluidic chip cartridge shown in FIG. 2A.

The microfluidic chip cartridge 20, as shown in FIGS. 2A-2B, provided by the present invention is to combine with the fluidic connectors 10 as illustrated above, wherein FIG. 2A is a bottom view of the microfluidic chip cartridge 20 and FIG. 2B is a top view of the microfluidic chip cartridge 20. The microfluidic chip cartridge 20 comprises: a microfluidic chip 21; a case body 22, having a recess R22 on a first side S201 of the case body 22 to receive the microfluidic chip 21; a first fluid delivery interface 23 on a second side S202 of the case body 22, having plurality of fluid guide channels H23 connecting the bottom of the recess R22; and a second fluid delivery interface 24 on the second side S202 of the case body 22, having at least two fluid guide channels H24 connecting the bottom of the recess R22 as well. Wherein the second side S202 is opposite to the first side S201; and at least a part of the first fluid delivery interface 23 is separated from the second fluid delivery interface 24 to form a hollow window W22 on the second side S202 of the case body 22, and therefore the partial microfluidic chip 21 would be exposed by the case body 22.

Shapes/formations of the first fluid delivery interface 23 and the second delivery interface 24 are not limited herein. For instance, FIG. 2A shows only a part of the first fluid delivery interface 23 is separated from the second fluid delivery interface 24 to form the hollow window W22, and the hollow window W22 is defined entirely by the first fluid delivery interface 23 and the second delivery interface 24. The another embodiment of the present invention is as shown in FIG. 2D, the first fluid delivery interface 23 is totally separated from the second fluid delivery interface 24 to form the hollow window W22, and the hollow window W22 is defined by the first fluid delivery interface 23, the second delivery interface 24 and the case body 22 (i.e. parts of two sidewalls of the recess R22). In an embodiment, the first fluid delivery interface 23, the second delivery interface 24 and the case body 22 are all separately formed; and in other embodiments, at least two of them can be a one-piece structure. For example, the first fluid delivery interface 23 and the second delivery interface 24 are a one-piece structure; and for another instance, the first fluid delivery interface 23, the second delivery interface 24, and the case body 22 are a one-piece structure.

Figure 2C:
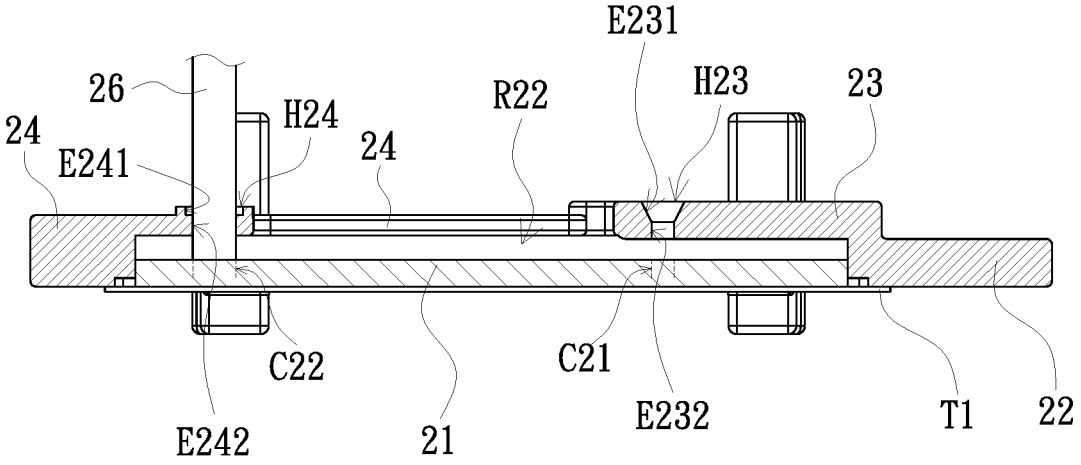
FIG. 2C is a cross sectional view of the microfluidic chip cartridge along line a-b in FIG. 2B.
Figure 2D:
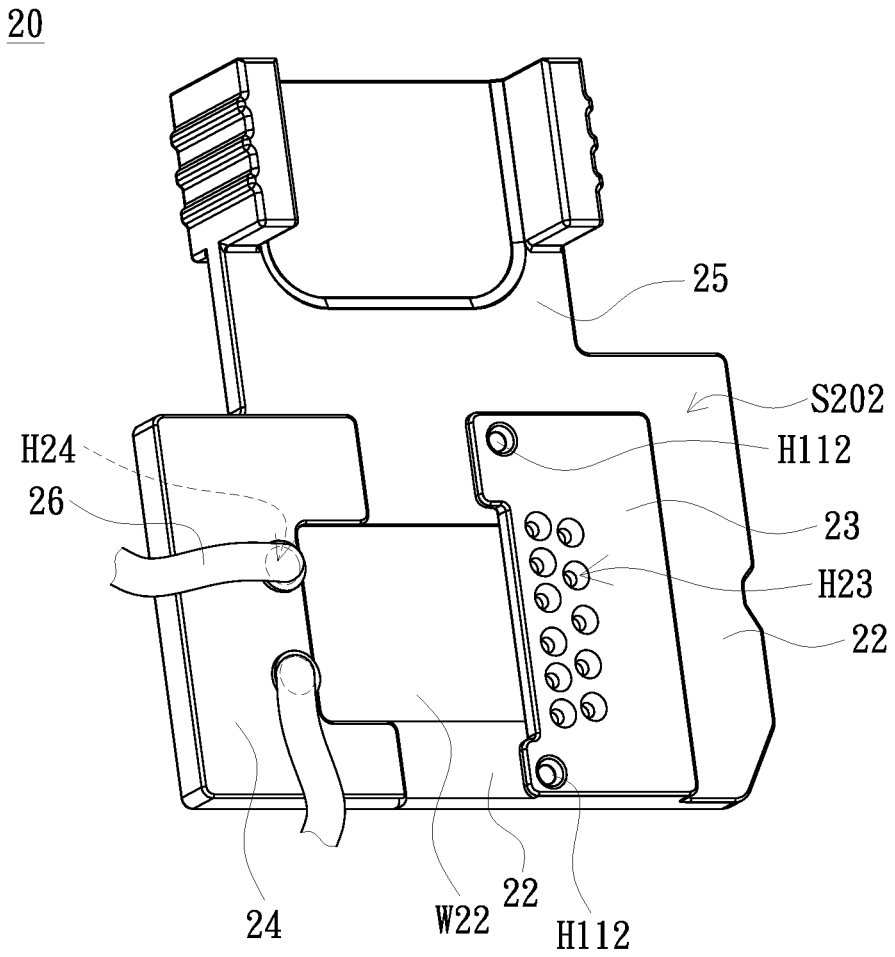
FIG. 2D is a top view of a microfluidic chip cartridge according to another embodiment of the present invention.

FIG. 2C is a cross sectional view of the microfluidic chip cartridge 20 along line a-b in FIG. 2B. Each fluid delivery channel H23 of the first fluid delivery interface 23 has a proximal end E231 and a terminal end E232 interconnecting with the proximal end E231. Each proximal end E231 has a chamfer as shown in FIG. 2C to guide the protrusion portion 121 of the soft tube 12 to the position of insertion into the microfluidic chip 21 correctly, and the proximal end E231 is contacted with the fluidic connector 10 and connected to the through hole H11 of the fluidic connector 10 when the microfluidic chip cartridge 20 is assembled with the fluidic connector 10; and the terminal end E232 is aligned with a corresponding inlet/outlet C21 of the microfluidic chip 21. Similar to the fluid delivery channels H23, each fluid delivery channel H24 of the second fluid delivery interface 24 has a proximal end E241 and a terminal end E242. Each proximal end E241 is wider than the corresponding terminal end E242. In this embodiment, the fluid delivery channel H24 is has a T-shaped formation as shown in FIG. 2C for easier insertion; however in other embodiments of the invention, each fluid delivery channel H24 can has a similar taper formation like the fluid delivery channel H23, and each proximal end E241 can has a chamfer to guide a tube for inletting samples to the position of insertion into the microfluidic chip 21 correctly. The terminal end E242 is aligned with a corresponding inlet/outlet C22 of the microfluidic chip 21. FIG. 2C only shows a part of inlet/outlet C21 and a part of inlet/outlet C22 without details of the network of microfluidic chip 21 for simple illustration. And it is noted that sizes of the inlets/outlets C21 and C22, the fluid delivery channels H23 and H24, the proximal ends E231 and E241, and the terminal ends E232 and E242 may not be correct proportion with respect to the microfluidic chip 21 and the case body 22, for the purpose of illustration and easier understanding, but it is not intended to limit the present invention. It is also noted that in FIG. 2C, it shows the fluid guide channels H23 and H24 are separated from the microfluidic chip 21, however, the fluid guide channels H23 and H24 can directly connect to the microfluidic chip 21 in other embodiments to interconnect with the corresponding inlets/outlets C21 and C22 respectively. It has an advantage that a sample for analysis may not leak out even the soft tubes 12 or the inlet tube are not inserted into the microfluidic chip 21 perfectly.

In addition, in some embodiments for the purpose of easy holding, the microfluidic chip cartridge 20 may further include a holder 25 as shown in FIGS. 2A and 2B, connected to the case body 22 and along an extending direction of the case body 22. Moreover, the microfluidic chip cartridge 20 may also include at least one pin hole H112 corresponding to the plug pin 112 for assembly and combination with the fluidic connector 10. The microfluidic chip 21 may be fastened in the recess R22 of the case body 22 by fixing on a transparent carrier Ti, which is affixed on the first side S201 of the case body 22 as shown in FIGS. 2A and 2C. Moreover, at least one tube 26 is optionally included as shown in FIGS. 2A-2C and may be fixed in the fluid delivery channel H24. The tube 26 is an inlet tube for inject the sample into the microfluidic chip 21. The tube 26 can be fixed in the fluid guide channel H24 by an adhesive, or can be replaceable and assembled manually before an analysis.

Figure 3:
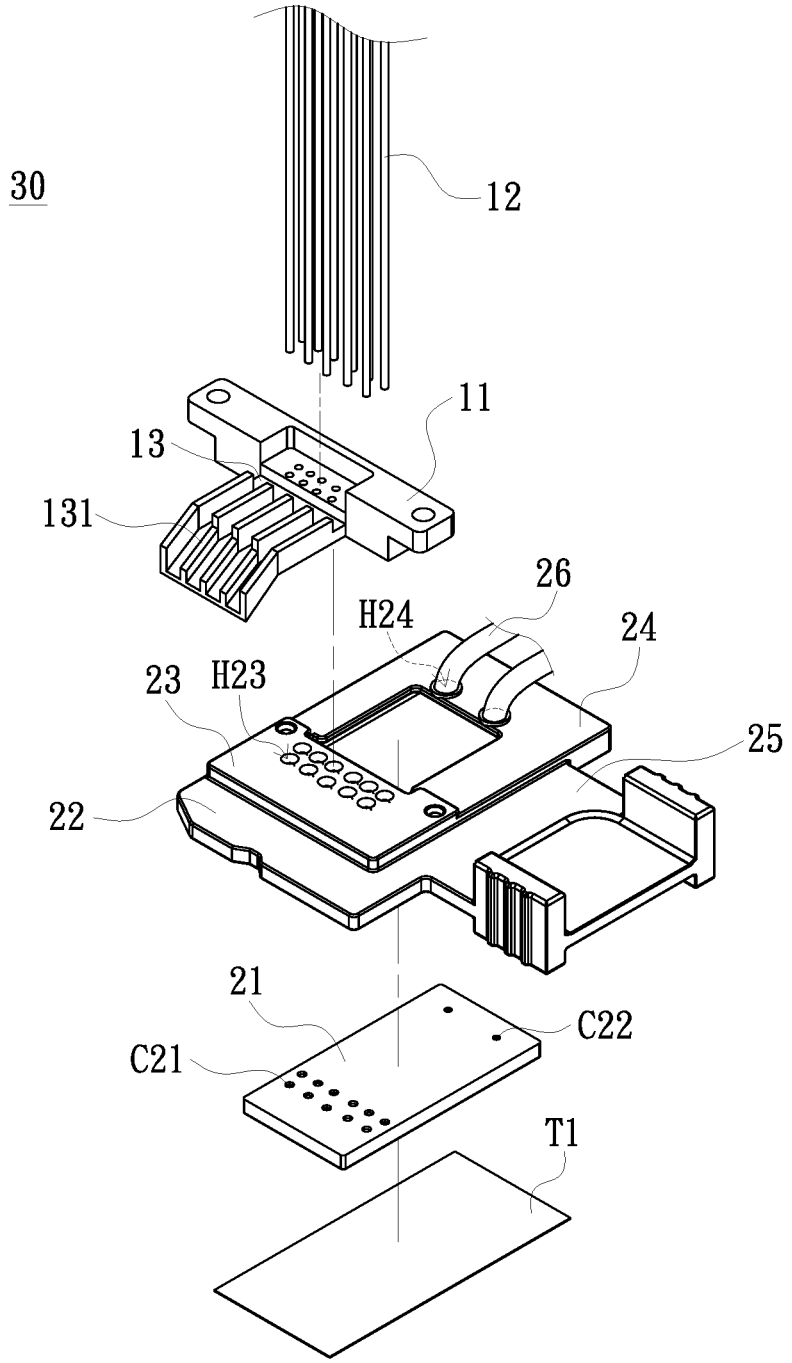
FIG. 3 is a fluidic connector assembly according to the present invention.

The present invention also provides a fluidic connector assembly 30, comprising the fluidic connector 10 and the microfluidic chip cartridge 20 as afore illustrated. When the fluidic connector 10 is assembled with the microfluidic chip cartridge 20, the protrusion portions 121 of the soft tubes 12 pass through the fluid guide channels H23 of the first fluid delivery interface 23 and then insert into the inlet/outlet C21 of the microfluidic chip 21. In the case of the fluidic connector 10 includes at least one plug pin 112 and the microfluidic chip cartridge 20 includes at least one plug pin hole H112, the plug pin 112 is inserted into the corresponding pin hole H112 to combine with the fluidic connector 10 and the microfluidic chip cartridge 20. In addition, the microfluidic chip 21 is better to be a soft microfluidic chip, e.g. a microfluidic chip made by liquid silicon robber material. It is not just for the soft tube 12 to insert into the microfluidic chip 21 easier without damage the microfluidic chip 21 but also the microfluidic chip 21 can provide tensile pressure to the protrusion portions 121 of the soft tube 12 for stable insertion during the analysis. It is noted that, FIG. 3 use the exemplar fluidic connector 10 as shown in FIG. 1D for illustration, but it is not intended to limit the present invention. The fluidic connector assembly 30 can have any combination of above illustrated different fluidic connectors 10 and microfluidic chip cartridges 20 depending on different applications.

Therefore, the present invention provides a fluidic connector, a microfluidic chip cartridge, and a microfluidic chip assembly thereof to improve efficiency and accuracy of insertion of inlet/outlet tubes to a microfluidic chip. The fluidic connector, microfluidic chip cartridge, and microfluidic chip assembly can be used independently in individual laboratory or analysis, or can be applied in an analysis platform machine.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fluidic connector assembly, comprising:

a fluidic connector, comprising:

a base, having a plurality of through holes; and a plurality of soft tubes, penetrating the base via the through holes and fixed on the base, and having a Shore A hardness in a range of 50-99, wherein an end of the plurality of soft tubes is protruded from a first side of the base to form a protrusion portions having a length in a range of 0.5-10 mm; and a microfluidic chip cartridge, comprising:

a microfluidic chip;

a case body having a recess on a first side of the case body to receive the microfluidic chip;

a first fluid delivery interface on a second side of the case body, having plurality of fluid guide channels connecting the bottom of the recess; and a second fluid delivery interface on a second side of the case body, having at least two fluid guide channel connecting the bottom of the recess;

wherein a part of the first fluid delivery interface is separated from the second fluid delivery interface to form a hollow window on the second side of the case body, therefore the partial microfluidic chip would be exposed outside of the case body;

wherein the microfluidic chip is fastened in the recess of the case body by a transparent carrier, which is affixed on the first side of the case body; and wherein the protrusion portions of the soft tubes pass through the fluid guide channels of the first fluid delivery interface and are inserted into the microfluidic chip.

2. The fluidic connector assembly according to claim 1, wherein the fluidic connector further comprises at least one plug pin, the case body further has at least one pin hole on the second side, and at least one plug pin is inserted into the at least one pin hole to combine with the fluidic connector and the microfluidic chip cartridge.

3. The fluidic connector assembly according to claim 1, wherein each fluid delivery channel of the first fluid delivery interface has a proximal end and a terminal end, each proximal end has a chamfer to guide the protrusion portion of the soft tube into the microfluidic chip, and the terminal end is connected to a corresponding inlet/outlet of the microfluidic chip.

4. The fluidic connector assembly according to claim 1, wherein the length of the protrusion portion is in a range of 4.4-10 mm, and the Shore A hardness is in a range of 70-99.

* * * * *